US005418333A

United States Patent [19]

Sanders

[11] Patent Number: 5,418,333

[45] Date of Patent: May 23, 1995

[54] STRANDED ELLIPTICAL CABLE AND METHOD FOR OPTIMIZING MANUFACTURE THEREOF

[75] Inventor: Eugene T. Sanders, Carrollton, Ga.

[73] Assignee: Southwire Company, Carrollton, Ga.

[21] Appl. No.: 87,305

[22] Filed: Jul. 8, 1993

[51] Int. Cl.[6] ..... H01B 5/08; D02G 3/36; D07B 1/06

[52] U.S. Cl. ..... 174/129 R; 174/42; 174/128.1; 57/15; 57/215; 57/219; 57/314

[58] Field of Search ..... 174/129 R, 42, 128.1; 57/214, 215, 218, 219, 311, 314, 15

[56] References Cited

U.S. PATENT DOCUMENTS

| | | | |
|---|---|---|---|
| 429,005 | 5/1890 | Bird . | |
| 1,955,024 | 4/1934 | Rohs . | |
| 1,996,186 | 4/1935 | Affel . | |
| 1,999,502 | 4/1935 | Hall . | |
| 2,122,911 | 7/1938 | Hunter et al. . | |
| 2,135,800 | 11/1938 | Davignon . | |
| 2,156,652 | 5/1939 | Harris | 57/145 |
| 2,217,276 | 10/1940 | Hill et al. . | |
| 2,587,521 | 2/1952 | Peterson . | |
| 2,620,618 | 12/1952 | Chamoux . | |
| 3,538,702 | 11/1970 | Wolf et al. . | |
| 3,624,276 | 11/1971 | Rawlins et al. | 174/129 R |
| 3,659,038 | 4/1972 | Shealy | 174/129 R |
| 3,778,993 | 12/1973 | Glushko et al. | 57/145 |
| 3,916,083 | 10/1975 | Yakovlev et al. | 174/42 |
| 4,244,172 | 1/1981 | Glushko et al. | 57/215 |
| 4,436,954 | 3/1984 | Kaderjak et al. | 174/128 R |
| 4,605,819 | 8/1986 | Warburton | 174/127 |
| 5,171,942 | 12/1992 | Powers | 174/129 R |
| 5,260,516 | 11/1993 | Blackmore | 174/113 A |

FOREIGN PATENT DOCUMENTS

| | | | |
|---|---|---|---|
| 905155 | 1/1954 | Germany | 174/129 R |
| 547101 | 8/1956 | Italy . | |
| 125286 | 7/1957 | U.S.S.R. . | |

*Primary Examiner*—Morris H. Nimmo
*Attorney, Agent, or Firm*—Stanley L. Tate; James W. Wallis, Jr.

[57] ABSTRACT

A method of manufacture and a resultant cable structure of elliptical stranded cable which optimizes the use of existing conventional stranding machines. In accordance with the present invention, one or more layers of shaped, non-circular, wires are interposed to provide support between the inner core of substantially round wires each having essentially the same diameter and the outer layer of round wires of different diameters, which outer layer includes round wires of different diameters which are arranged to provide the minor and major axes of the elliptical cable. The shaped wires are preferably trapezoidal in shape. Alternatively, the shaped wires may be arcuately shaped elliptical wires subtending an angle determined by dividing 360° by the number of shaped wires (for example, 30° for a twelve wire layer) and having an aspect ratio (ratio of major axis X dimension to minor axis Y dimension) sufficient to provide support between the inner core and outer layer of round wires. As a result of the use of such wires, the elliptical cable can be made by using the smallest capacity machine for a given size of cable, thereby optimizing the use of such machinery and minimizing the time spent in stranding.

10 Claims, 2 Drawing Sheets

$$\text{ASPECT RATIO} = \frac{X''\text{ DIMENSION}}{Y''\text{ DIMENSION}}$$

STRANDED ELLIPTICAL CABLE AND METHOD FOR OPTIMIZING MANUFACTURE THEREOF

FIELD OF THE INVENTION

This invention relates generally to a stranded elliptical cable and a method of manufacture thereof which optimizes the use of standard wire stranding machines to produce elliptical cable having desired aspect ratios.

BACKGROUND OF THE INVENTION

In order to minimize the susceptibility of overhead electrical cable to aerodynamically-induced vibrations and other related phenomena, it is desirable to produce cable having an elliptical cross-section, with the major and minor axes thereof rotated along the length of the cable. Various designs of such elliptical cable are known in the art. One particular design of such elliptical cable is disclosed in U.S. Pat. No. 5,171,942 entitled "Oval Shaped Overhead Conductor and Method for Making Same", commonly assigned to the assignee of the present application, and hereby incorporated by reference herein.

Although the problem of damping of undesired vibration has been solved by the invention of the above-identified patent, the actual manufacture of such cable so as to optimize the use of standard stranding machines has remained unaddressed in the prior art.

Stranded cables are typically produced on conventional stranding machines such as those manufactured by Krupp GmbH, Essen, Germany. Such stranding machines include a series of wire guides which provide the capability of stranding a plurality of concentric wire layers simultaneously. Such machines are designed to strand round or circular cross-section wires of uniform diameters. For example, Krupp Model No. KVS 1+12+18 has two sets of wire guides which provide the capability of stranding an inner layer of twelve wires simultaneously with an outer layer of eighteen wires. Krupp Model No. KVS 1+12+18+24 has three sets of wire guides which provide the capability of stranding an inner layer of twelve wires, an intermediate layer of eighteen wires and an outer layer of twenty-four wires. And yet another Krupp machine, as modified, has four sets of wire guides which provide the capability of stranding an inner layer of twelve wires, a first intermediate layer of eighteen wires, a second intermediate layer of twenty-four wires and an outer layer of thirty wires.

The numbers of wires in the respective layers is a function of conventional cable design in which cable having a substantially circular cross-section is produced by stranding round wires of uniform diameter. As a consequence, the packing of wires of uniform diameter in a closely packed matrix results in each succeeding layer having a predetermined number of wires therein. Conventional stranding machines are thus designed to optimize such production requirements using wires of a uniform diameter.

Specifically, geometry dictates that, in a closely packed matrix of uniform diameter wires, each successive layer will have a predetermined number of wires therein, in the progression of 1, 6, 12, 18, 24, etc. Thus, the conventional stranding machines are designed to produce successive layers in accordance with the dictates of geometry.

Departure from the standard practice of producing cables of essentially circular cross-section by stranding round wires of uniform diameter alters the geometry of close-packed matrices for non-circular cross-section cables. For example, stranding a cable having an elliptical cross-section alters the packing of wires because the same size wires are not used throughout. As a result, in order to properly fill the interstices in the conductor matrix, a greater number of wires may be required for a particular layer than would otherwise be required for a circular cross-section conductor. This alters the ratio of wires from the standard 1:6:12:18:24:30 progression, as measured for each layer in the outwardly radial direction.

While the elliptical cable designs can be stranded using standard stranding machines, the mixture or progression of numbers of wires required for each layer frequently alters the numbers of wires in each layer and requires the use of a larger capacity machine than would normally be justified in order to strand the cable in a single pass through the machine. Alternatively, smaller capacity machines can be used, but require more than one pass. In either instance, the cost of manufacture is increased and the efficiency reduced. The present invention addresses this problem.

SUMMARY OF THE INVENTION

The present invention overcomes the aforementioned problems in the manufacture of elliptical stranded cable by providing a method of manufacture and a resultant cable structure which optimizes the use of existing standard stranding machines. In accordance with the present invention, one or more layers of shaped, non-circular, wires are interposed to provide support between the inner core of substantially round wires each having essentially the same diameter and the outer layer of round wires of different diameters, which outer layer is comprised of round wires of different diameters which are arranged to provide the minor and major axes of the elliptical cable. The shaped wires are preferably trapezoidal in shape.

Alternatively, the shaped wires may be arcuately shaped elliptical wires subtending an angle determined by dividing 360° by the number of shaped wires (for example, 30° for a twelve wire layer) and having an aspect ratio (ratio of major axis X dimension to minor axis Y dimension) sufficient to provide support between the inner core and outer layer of round wires. As a result of the use of such wires, the elliptical cable can be made by the smallest capacity machine for a given size of cable, thereby optimizing the use of such machinery and minimizing the time spent in stranding.

With the foregoing and other advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
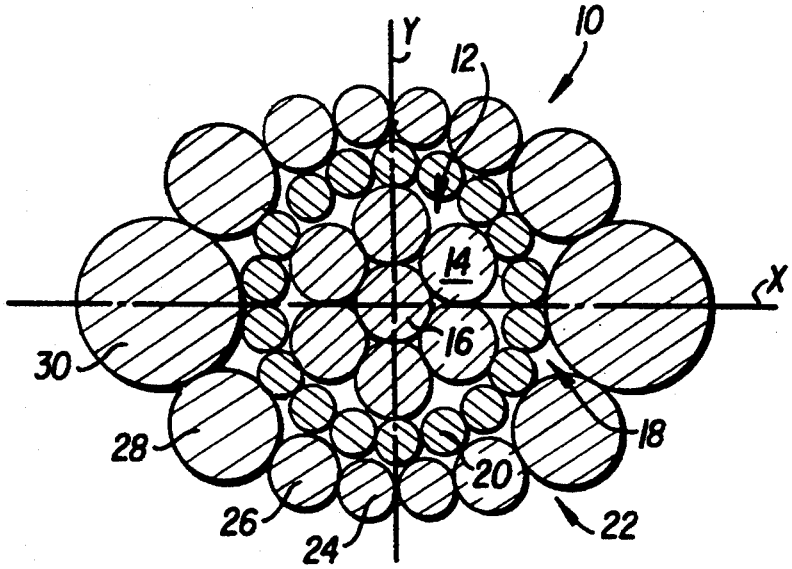
FIG. 1 (PRIOR ART)
FIG. 1 is a cross-sectional view of a prior art elliptical cable which is produced without regard to optimization of the use of existing stranding machinery.

Referring now to the drawings in detail, there is illustrated in FIG. 1 an elliptical conductor produced in accordance with the prior art and designated generally by the numeral 10. The conductor 10 includes three layers of wires. The first layer is the core, designated by the numeral 12, comprised of six round wires 14 wound about a center wire 16, (six wires overwrapping one) with each core wire having essentially the same diameter. An intermediate layer 18 of wires is wound about the core 12. Intermediate layer 18 is comprised of eighteen round wires 20, each of the same diameter. An outer layer 22 is wound about and supported by intermediate layer 18. Outer layer 22 is comprised of fourteen symmetrically arranged wires 24, 26, 28, 30 of diameters determined by location in the matrix with the diameters increasing in the direction of the major axis X from the minor axis Y of the stranded cable.

This configuration provides an elliptical conductor which minimizes the susceptibility to aerodynamically-induced vibrations, such as that disclosed in U.S. Pat. No. 5,171,942. However, because the conductor comprises eighteen inner wires, rather than using a thirty wire stranding machine that has the capacity to strand twelve inner wires and eighteen outer wires, it is necessary to use a fifty-four wire stranding machine, by-passing the twelve strand guides and utilizing the eighteen strand guides and the twenty-four strand guides in order to strand the cable in a single pass through the machine. Thus, in order to strand a total of only thirty-two wires (18 plus 14), it is necessary to use a fifty-four wire stranding machine. This is a highly inefficient use of manufacturing resources and equipment.

Figure 2:
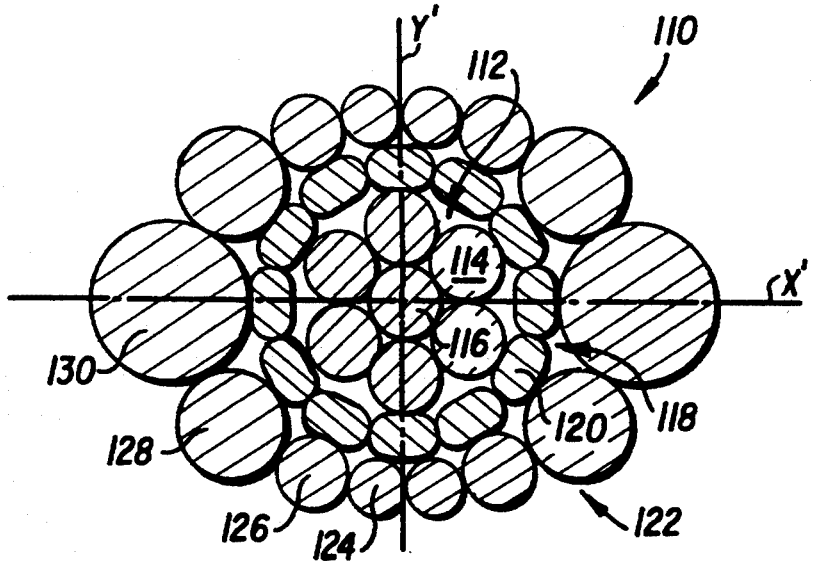
FIG. 2 is a cross-sectional view of an elliptical cable which is produced according to the present invention so as to optimize the use of existing stranding machinery.

A stranded cable constructed in accordance with the invention, having the same overall dimensions and profile as the prior art cable 10 but designed to optimize the manufacture thereof, is illustrated in FIG. 2 and designated generally by the numeral 110. The cable 110 includes a core layer 112 of seven wires 114, 116 (six wires overwrapping one). However, an intermediate layer 118, of only twelve trapezoidally shaped or arcuately shaped wires 120 is wound about the core 112. The shaped wires arcuate and essentially elliptically shaped, subtending an angle of 30° (360° divided by 12 wires) and, having an aspect ratio (ratio of major axis X′ dimension to minor axis Y′ dimension) sufficient to provide support between the inner core layer 112 and outer layer 122. The identical fourteen wire outer layer 122 as in FIG. 1 (but comprised of wires designated 124, 126, 128, 130) is wound about intermediate layer 118. By using the shaped wires 120 in the intermediate layer 118, an identically-shaped elliptical cable can be made as in FIG. 1. However, because a smaller number of wires is required to take up the same circumferential space as a larger number of round wires, only twelve inner wires and fourteen outer wires are used, resulting in a total of twenty-six wires. Consequently, the cable 110 can be stranded in a single pass using a thirty wire stranding machine (twelve inner guides and eighteen outer guides). This optimizes the use of stranding machinery by reducing the size of the strander one entire size.

Figure 3:
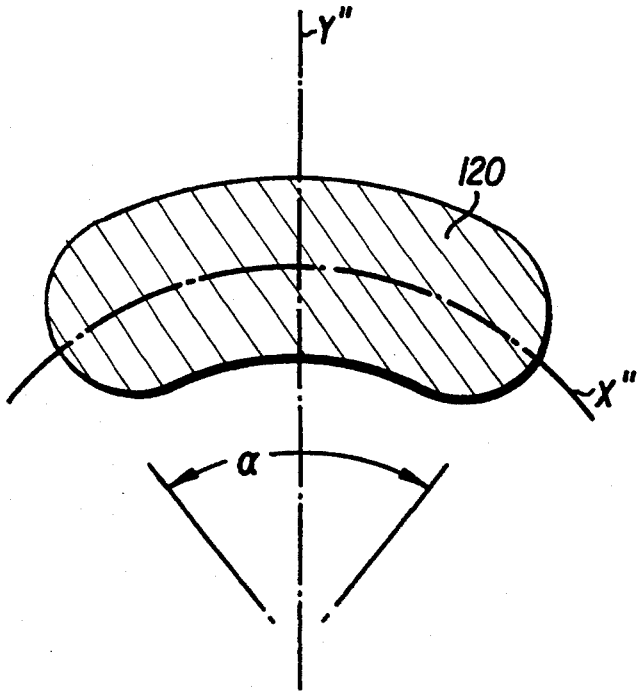
FIG. 3 is a cross-sectional view of a shaped wire produced according to the present invention.

FIG. 3 is a cross-sectional view of one of the shaped wires 120 used to optimize the use of existing stranding machines. A standard round wire is passed through a die so as to form a shaped wire. The die is configured to produce a wire which is essentially elliptical in shape, but bent in an arcuate fashion along the major axis thereof. The aspect ratio of the major axis X″ to the minor axis Y″ is selected to provide proper support between the core layer and outer layer wires. The shaped wire 120 subtends an angle $\alpha$ of approximately 30° for a layer having twelve such shaped wires. For a different number of wires, a different aspect ratio and subtended angle can be used, provided that a proper circumferential coverage is achieved and supporting contact is made between layers.

By using the trapezoidal or arcuately shaped wires, as shown in FIGS. 2 and 3 and as discussed above, an elliptically-shaped conductor which minimizes susceptibility to aerodynamically-induced vibrations can be produced with a smaller number of wires than in the prior art, thereby optimizing the use of conventional stranding equipment.

Although a certain presently preferred embodiment of the invention has been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A method of stranding elliptically shaped cable having a major axis and a minor axis and including a plurality of layers for optimum stranding on a conventional stranding machine, said stranding machine having the capacity to strand multiple layers in a single pass, each layer having a maximum number of wires therein, comprising the steps of:

providing a core of round wires in a compact..matrix structure;

stranding an inner layer of shaped wires, said shaped wires being shaped so as to support one or more outer layers of wires against said core, said shaped wires being of a number not exceeding a maximum capacity of said stranding machine for said inner layer; and stranding an outer layer of round wires, said round wires increasing in diameter in the direction of the major axis, thereby producing an elliptical cable having an optimum number of wires therein for stranding on a conventional stranding machine;

wherein the shaped wires are each elliptical and bent arcuately, each subtending an angle determined by dividing 360° by the number of shaped wires and each having an aspect ratio sufficient to provide support between said core and said outer layer.

2. A method of stranding elliptically shaped cable having a major axis and a minor axis and including a plurality of layers for optimum stranding on a conventional stranding machine, said stranding machine having the capacity to strand multiple layers in a single pass, each layer having a maximum number of wires therein, comprising the steps of:

providing a core of round wires in a compact matrix structure;

stranding an inner layer of shaped wires, said shaped wires being shaped so as to support one or more outer layers of wires against said core, said shaped wires being of a number not exceeding a maximum capacity of said stranding machine for said inner layer; and stranding an outer layer of round wires, said round wires increasing in diameter in the direction of the major axis, thereby producing an elliptical cable having an optimum number of wires therein for stranding on a conventional stranding machine;

wherein the shaped wires are each trapezoidal in shape.

3. A stranded elliptical cable having a major axis and a minor axis and including a plurality of layers for optimum stranding on a conventional stranding machine, said conventional stranding machine having the capacity to strand multiple layers in a single pass, each layer having a maximum number of wires therein, comprising:

a core of round wires in a compact matrix structure;

an inner layer of shaped wires, said shaped wires being shaped so as to support one or more outer layers of wires against said core and being of a number not exceeding a maximum capacity of said stranding machine for said inner layer; and one or more outer layers of round wires, said round wires increasing in diameter in the direction of the major axis, wherein said elliptical cable has an optimum number of wires therein for stranding on a conventional stranding machine;

wherein the shaped wires are each elliptical and bent arcuately, each subtending an angle determined by dividing 360° by the number of shaped wires and each having an aspect ratio sufficient to provide support between said core and said one or more outer layers.

4. A stranded elliptical cable having a major axis and a minor axis and including a plurality of layers for optimum stranding on a conventional stranding machine, said conventional stranding machine having the capacity to strand multiple layers in a single pass, each layer having a maximum number of wires therein, comprising:

a core of round wires in a compact matrix structure;

an inner layer of shaped wires, said shaped wires being shaped so as to support one or more outer layers of wires against said core and being of a number not exceeding a maximum capacity of said stranding machine for said inner layer; and one or more outer layers of round wires, said round wires increasing in diameter in the direction of the major axis, wherein said elliptical cable has an optimum number of wires therein for stranding on a conventional stranding machine;

wherein the shaped wires are each trapezoidal in shape.

5. A method of stranding elliptically shaped cable having a major axis and a minor axis and including a plurality of layers for optimum stranding on a conventional stranding machine, said stranding machine having the capacity to strand multiple layers in a single pass, each layer having a maximum number of wires therein, comprising the steps of:

providing a core of at least one round wire;

stranding at least one inner layer of shaped wires, said shaped wires being shaped so as to support at least one outer layer of wires against said core and being of a number not exceeding a maximum capacity of said stranding machine for said inner layer; and stranding an outer layer of round wires, said round wires increasing in diameter in the direction of the major axis, thereby producing an elliptical cable having an optimum number of wires therein for stranding on a conventional stranding machine;

wherein the shaped wires are each elliptical and bent arcuately, each subtending an angle determined by dividing 360° by the number of shaped wires and each having an aspect ratio sufficient to provide support between said core and said outer layer.

6. A stranded elliptical cable made in accordance with the method of claim 5.

7. A method of stranding elliptically shaped cable having a major axis and a minor axis and including a plurality of layers for optimum stranding on a conventional stranding machine, said stranding machine having the capacity to strand multiple layers in a single pass, each layer having a maximum number of wires therein, comprising the steps of:

providing a core of at least one round wire;

stranding at least one inner layer of shaped wires, said shaped wires being shaped so as to support at least one outer layer of wires against said core and being of a number not exceeding a maximum capacity of said stranding machine for said inner layer; and stranding an outer layer of round wires, said round wires increasing in diameter in the direction of the major axis, thereby producing an elliptical cable having an optimum number of wires therein for stranding on a conventional stranding machine;

wherein the shaped wires are each trapezoidal in shape.

8. A stranded elliptical cable made in accordance with the method of claim 7.

9. A stranded elliptical cable having a major axis and a minor axis and including a plurality of layers for optimum stranding using a conventional stranding machine, said conventional stranding machine having the capacity to strand multiple layers in a single pass, each layer having a maximum number of wires therein, comprising:

a core of round wires in a compact matrix structure;

an inner layer of shaped wires, said shaped wires being shaped so as to support an outer layer of wires against said core and being of a number not exceeding a maximum capacity of said stranding machine for said inner layer;

one or more outer layers of round wires, said round wires increasing in diameter in the direction of the major axis, wherein said elliptical cable has an optimum number of wires therein for stranding on a conventional stranding machine; and wherein the shaped wires are each elliptical and bent arcuately, each subtending an angle determined by dividing 360° by the number of shaped wires and each having an aspect ratio sufficient to provide support between said core and said one or more outer layers.

10. A stranded elliptical cable having a major axis and a minor axis and including a plurality of layers for optimum stranding using a conventional stranding machine, said conventional stranding machine having the capacity to strand multiple layers in a single pass, each layer having a maximum number of wires therein, comprising:

a core of round wires in a compact matrix structure;

an inner layer of shaped wires, said shaped wires being shaped so as to support an outer layer of wires against said core and being of a number not exceeding a maximum capacity of said stranding machine for said inner layer; and one or more outer layers of round wires, said round wires increasing in diameter in the direction of the major axis, wherein said elliptical cable has an optimum number of wires therein for stranding on a conventional stranding machine;

wherein the shaped wires are each trapezoidal in shape.

* * * * *